US009301349B2

(12) United States Patent
Zhu et al.

(10) Patent No.: US 9,301,349 B2
(45) Date of Patent: Mar. 29, 2016

(54) SYSTEMS AND METHODS FOR DIMMING CONTROL USING SYSTEM CONTROLLERS

(75) Inventors: Liqiang Zhu, Shanghai (CN); Jun Zhou, Shanghai (CN); Lieyi Fang, Shanghai (CN)

(73) Assignee: On-Bright Electronics (Shanghai) Co., Ltd., Shanghai (CN)

( * ) Notice: Subject to any disclaimer, the term of this patent is extended or adjusted under 35 U.S.C. 154(b) by 455 days.

(21) Appl. No.: 13/527,475

(22) Filed: Jun. 19, 2012

(65) Prior Publication Data

US 2013/0307431 A1 Nov. 21, 2013

(30) Foreign Application Priority Data

May 17, 2012 (CN) ..... 2012 1 0166672

(51) Int. Cl.

| | |
|---|---|
| ***H05B 33/08*** | (2006.01) |
| ***H05B 37/02*** | (2006.01) |
| ***H05B 39/04*** | (2006.01) |
| ***H05B 41/36*** | (2006.01) |
| ***G05F 1/00*** | (2006.01) |

(52) U.S. Cl.

CPC ..... *H05B 33/0815* (2013.01); *H05B 33/0851* (2013.01)

(58) Field of Classification Search

None

See application file for complete search history.

(56) References Cited

U.S. PATENT DOCUMENTS

| | | | |
|---|---|---|---|
| 3,803,452 | A | 4/1974 | Goldschmied |
| 4,253,045 | A | 2/1981 | Weber |
| 5,144,205 | A | 9/1992 | Motto et al. |
| 5,949,197 | A | 9/1999 | Kastner |
| 6,218,788 | B1 | 4/2001 | Chen et al. |
| 6,229,271 | B1 | 5/2001 | Liu |
| 7,038,399 | B2 | 5/2006 | Lys et al. |
| 7,649,327 | B2 | 1/2010 | Peng |
| 7,880,400 | B2 | 2/2011 | Zhou et al. |

(Continued)

FOREIGN PATENT DOCUMENTS

| | | | |
|---|---|---|---|
| CN | 1448005 | A | 10/2003 |
| CN | 101657057 | A | 2/2010 |

(Continued)

OTHER PUBLICATIONS

Taiwan Intellectual Property Office, Office Action mailed Jan. 7, 2014, in Application No. 100119272.

(Continued)

*Primary Examiner* — Douglas W Owens
*Assistant Examiner* — Dedei K Hammond
(74) *Attorney, Agent, or Firm* — Jones Day

(57) ABSTRACT

System and method for dimming control. The system includes a system controller, a transistor, and a resistor. The system controller includes a first controller terminal and a second controller terminal. The transistor includes a first transistor terminal, a second transistor terminal and a third transistor terminal. The resistor including a first resistor terminal and a second resistor terminal. The first transistor terminal is coupled, directly or indirectly, to the second controller terminal. The first resistor terminal is coupled to the second transistor terminal. The second resistor terminal is coupled to the third transistor terminal. The system controller is configured to receive an input signal at the first controller terminal and to generate an output signal at the second controller terminal. The transistor is configured to receive the output signal at the first transistor terminal and to change between a first condition and a second condition.

28 Claims, 11 Drawing Sheets

(56) References Cited

U.S. PATENT DOCUMENTS

| | | | | |
|---|---|---|---|---|
| 7,944,153 | B2 | 5/2011 | Greenfeld | |
| 8,134,302 | B2 * | 3/2012 | Yang et al. | 315/219 |
| 8,278,832 | B2 * | 10/2012 | Hung et al. | 315/219 |
| 8,378,583 | B2 | 2/2013 | Hying et al. | |
| 8,378,588 | B2 | 2/2013 | Kuo et al. | |
| 8,378,589 | B2 | 2/2013 | Kuo et al. | |
| 8,432,438 | B2 | 4/2013 | Ryan et al. | |
| 8,497,637 | B2 | 7/2013 | Liu | |
| 8,644,041 | B2 | 2/2014 | Pansier | |
| 8,698,419 | B2 | 4/2014 | Yan et al. | |
| 8,890,440 | B2 | 11/2014 | Yan et al. | |
| 8,941,324 | B2 | 1/2015 | Zhou et al. | |
| 9,030,122 | B2 | 5/2015 | Yan et al. | |
| 9,220,136 | B2 | 12/2015 | Zhang | |
| 2006/0022648 | A1 | 2/2006 | Ben-Yaakov et al. | |
| 2007/0182699 | A1 | 8/2007 | Ha et al. | |
| 2007/0267978 | A1 | 11/2007 | Shteynberg et al. | |
| 2008/0224629 | A1 | 9/2008 | Melanson | |
| 2008/0278092 | A1 | 11/2008 | Lys et al. | |
| 2009/0021469 | A1 | 1/2009 | Yeo et al. | |
| 2009/0251059 | A1 | 10/2009 | Veltman | |
| 2010/0164406 | A1 | 7/2010 | Kost et al. | |
| 2010/0176733 | A1 | 7/2010 | King | |
| 2010/0207536 | A1 | 8/2010 | Burdalski | |
| 2010/0213859 | A1 | 8/2010 | Shteynberg | |
| 2011/0037399 | A1 | 2/2011 | Hung et al. | |
| 2011/0080110 | A1 | 4/2011 | Nuhfer et al. | |
| 2011/0080111 | A1 | 4/2011 | Nuhfer et al. | |
| 2011/0121744 | A1 | 5/2011 | Salvestrini | |
| 2011/0121754 | A1 | 5/2011 | Shteynberg | |
| 2011/0227490 | A1 | 9/2011 | Huynh | |
| 2011/0260619 | A1 | 10/2011 | Sadwick | |
| 2011/0285301 | A1 | 11/2011 | Kuang et al. | |
| 2011/0291583 | A1 | 12/2011 | Shen | |
| 2011/0309759 | A1 | 12/2011 | Shteynberg | |
| 2012/0032604 | A1 | 2/2012 | Hontele | |
| 2012/0146526 | A1 | 6/2012 | Lam et al. | |
| 2012/0181946 | A1 | 7/2012 | Melanson | |
| 2012/0268031 | A1 | 10/2012 | Zhou et al. | |
| 2012/0299500 | A1 | 11/2012 | Sadwick | |
| 2012/0326616 | A1 | 12/2012 | Sumitani et al. | |
| 2013/0009561 | A1 | 1/2013 | Briggs | |
| 2013/0026942 | A1 | 1/2013 | Ryan et al. | |
| 2013/0026945 | A1 | 1/2013 | Ganick et al. | |
| 2013/0027528 | A1 | 1/2013 | Staats et al. | |
| 2013/0063047 | A1 | 3/2013 | Veskovic | |
| 2013/0175931 | A1 | 7/2013 | Sadwick | |
| 2013/0181630 | A1 | 7/2013 | Taipale et al. | |
| 2013/0193879 | A1 | 8/2013 | Sadwick | |
| 2013/0215655 | A1 | 8/2013 | Yang et al. | |
| 2013/0241427 | A1 | 9/2013 | Kesterson et al. | |
| 2013/0241428 | A1 | 9/2013 | Takeda | |
| 2013/0242622 | A1 | 9/2013 | Peng | |
| 2013/0307434 | A1 | 11/2013 | Zhang | |
| 2014/0063857 | A1 | 3/2014 | Peng | |
| 2014/0265935 | A1 | 9/2014 | Sadwick | |
| 2014/0354170 | A1 | 12/2014 | Gredler | |
| 2015/0077009 | A1 | 3/2015 | Kunimatsu | |
| 2015/0091470 | A1 | 4/2015 | Zhou et al. | |

FOREIGN PATENT DOCUMENTS

| | | | |
|---|---|---|---|
| CN | 101868090 | | 10/2010 |
| CN | 101896022 | A | 11/2010 |
| CN | 101917804 | A | 12/2010 |
| CN | 101998734 | A | 3/2011 |
| CN | 102014551 | A | 4/2011 |
| CN | 102056378 | A | 5/2011 |
| CN | 102209412 | A | 10/2011 |
| CN | 102300375 | A | 12/2011 |
| CN | 102347607 | | 2/2012 |
| CN | 102387634 | A | 3/2012 |
| CN | 103004290 | | 3/2012 |
| CN | 102474953 | | 5/2012 |
| CN | 102497706 | | 6/2012 |
| CN | 102695330 | A | 9/2012 |
| CN | 102791056 | A | 11/2012 |
| CN | 202632722 | U | 12/2012 |
| CN | 102870497 | | 1/2013 |
| CN | 103024994 | A | 4/2013 |
| CN | 103313472 | | 9/2013 |
| CN | 103369802 | A | 10/2013 |
| CN | 103379712 | A | 10/2013 |
| CN | 103547014 | | 1/2014 |
| CN | 103716934 | | 4/2014 |
| CN | 103858524 | | 6/2014 |
| EP | 2403318 | A1 | 1/2012 |
| JP | 2008-010152 | A | 1/2008 |
| JP | 2011-249328 | A | 12/2011 |
| TW | 201215228 | A1 | 9/2010 |
| TW | 201125441 | A | 7/2011 |
| TW | 201132241 | | 9/2011 |
| TW | 201143530 | A | 12/2011 |
| TW | 201146087 | A1 | 12/2011 |
| TW | 201208463 | A1 | 2/2012 |
| TW | 201208481 | | 2/2012 |
| TW | 201208486 | | 2/2012 |
| TW | 201342987 | | 10/2013 |
| TW | 201412189 | A | 3/2014 |
| TW | 201417626 | A | 5/2014 |
| TW | 201417631 | | 5/2014 |
| TW | 201422045 | | 6/2014 |
| TW | 201424454 | A | 6/2014 |
| TW | I448198 | | 8/2014 |

OTHER PUBLICATIONS

China Patent Office, Office Action mailed Jul. 7, 2014, in Application No. 201210468505.1.

China Patent Office, Office Action mailed Jun. 3, 2014, in Application No. 201110103130.4.

Taiwan Intellectual Property Office, Office Action mailed Jun. 9, 2014, in Application No. 101124982.

United States Patent and Trademark Office, Office Action mailed May 27, 2014, in U.S. Appl. No. 13/105,780.

China Patent Office, Office Action mailed Nov. 15, 2014, in Application No. 201210166672.0.

Taiwan Intellectual Property Office, Office Action mailed Sep. 25, 2014, in Application No. 101148716.

United States Patent and Trademark Office, Office Action mailed Jan. 15, 2015, in U.S. Appl. No. 14/562,432.

China Patent Office, Office Action mailed Jun. 30, 2015, in Application No. 201410171893.6.

United States Patent and Trademark Office, Office Action mailed Jun. 5, 2015, in U.S. Appl. No. 13/710,277.

China Patent Office, Office Action mailed Aug. 28, 2015, in Application No. 201410322602.9.

China Patent Office, Office Action mailed Aug. 8, 2015, in Application No. 201410172086.6.

United States Patent and Trademark Office, Office Action mailed Aug. 19, 2015, in U.S. Appl. No. 14/562,432.

China Patent Office, Office Action mailed Oct. 19, 2015, in Application No. 201410322612.2.

Taiwan Intellectual Property Office, Office Action mailed Sep. 17, 2015, in Application No. 103127108.

Taiwan Intellectual Property Office, Office Action mailed Sep. 17, 2015, in Application No. 103127620.

United States Patent and Trademark Office, Office Action mailed Dec. 3, 2015, in U.S. Appl. No. 14/819,200.

China Patent Office, Office Action mailed Dec. 14, 2014, in Application No. 201210166672.0.

Taiwan Intellectual Property Office, Office Action mailed Nov. 13, 2015, in Application No. 103141628.

China Patent Office, Office Action mailed Dec. 14, 2015, in Application No. 201210166672.0.

United States Patent and Trademark Office, Office Action mailed Jan. 13, 2016, in U.S. Appl. No. 14/451,656.

United States Patent and Trademark Office, Notice of Allowance mailed Jan. 21, 2016, in U.S. Appl. No. 14/562,432.

(56) References Cited

OTHER PUBLICATIONS

United States Patent and Trademark Office, Notice of Allowance mailed Dec. 21, 2015, in U.S. Appl. No. 13/710,277.

United States Patent and Trademark Office, Office Action mailed Dec. 17, 2015, in U.S. Appl. No. 14/459,167.

United States Patent and Trademark Office, Office Action mailed Dec. 30, 2015, in U.S. Appl. No. 14/593,734.

* cited by examiner

SYSTEMS AND METHODS FOR DIMMING CONTROL USING SYSTEM CONTROLLERS

1. CROSS-REFERENCES TO RELATED APPLICATIONS

This application claims priority to Chinese Patent Application No. 201210166672.0, filed May 17, 2012, commonly assigned, incorporated by reference herein for all purposes.

Additionally, this application is related to U.S. patent application Ser. No. 13/105,780, filed May 11, 2011, which is incorporated by reference herein for all purposes.

2. BACKGROUND OF THE INVENTION

The present invention is directed to integrated circuits. More particularly, the invention provides systems and methods for dimming control with a system controller. Merely by way of example, the invention has been applied to light-emitting-diode (LED) driving systems. But it would be recognized that the invention has a much broader range of applicability.

Light emitting diodes (LEDs) have been widely used in various lighting applications because LEDs have significant advantages, such as high efficiency and long lifetime, over other lighting sources (e.g., incandescent lamps). LED lighting systems often use a conventional light dimmer that includes a Triode for Alternating Current (TRIAC) to adjust the brightness of LEDs. Such a conventional light dimmer is usually designed to drive pure resistive loads (e.g., incandescent lamps), and yet may not function properly when connected to capacitive loads, such as LEDs and/or associated circuits.

When the conventional light dimmer starts conduction, internal inductance of the light dimmer and the capacitive loads may cause low frequency oscillation. Hence, the Alternate Current (AC) waveforms of the conventional light dimmer often becomes unstable and/or distorted, resulting in flickering, undesirable audible noise, and/or even damages to other system components. FIG. 1 shows simplified signal waveforms of a conventional light dimmer that is connected to capacitive loads. The waveform 104 represents a voltage signal generated from a conventional light dimmer, and the waveform 102 represents a rectified signal generated from the voltage signal.

Some measures can be taken to solve the above problems in using a conventional light dimmer with capacitive loads such as LEDs and/or associated circuits. For example, a power resistor (e.g., with a resistance of several hundred Ohms) may be connected in series in an AC loop to dampen initial current surge when the light dimmer starts conduction.

FIG. 2 is a simplified diagram showing a conventional light dimmer system. The light dimmer system 200 includes a light dimmer 204, a rectifier 206, a capacitive load 208, and a power resistor 210. As shown in FIG. 2, the light dimmer 204 receives an AC input 202, and generates a signal 212 which is rectified by the rectifier 206. The rectifier 206 outputs a signal 214 to the capacitor load 208. The power resistor 210 serves to dampen the initial current surge when the light dimmer 204 starts conduction.

FIG. 3 shows simplified conventional signal waveforms of the light dimmer system 200. As shown in FIGS. 2 and 3, the waveform 304 represents the signal 212, and the waveform 302 represents the rectified signal 214. As shown by the waveforms of FIG. 3 compared with the waveforms in FIG. 1, using the resistor 210 in the light dimmer system 200 can reduce low frequency oscillation, and in addition the rectified signal 214 does not show any significant distortion. But, for the light dimmer system 200, a current would flow through the resistor 210 even under normal working conditions, causing excessive heating of resistor and other system components. Such heating often leads to low efficiency and high energy consumption.

Some conventional techniques would short the power resistor through peripheral circuits when the AC input is stabilized after a light dimmer conducts for a predetermined period of time. FIG. 4 is a simplified diagram showing a conventional system for dimming control. The system 400 includes an AC input 404, a light dimmer 402, a damping control circuit 406, a power train 408 and one or more LEDs 488. The damping control circuit 406 includes a power transistor 460, a capacitor 462, and resistors 472, 474, 476, 478 and 480. For example, the resistor 480 is the same as the resistor 210. In another example, the power transistor 460 is a N-type MOS switch.

As shown in FIG. 4, when the light dimmer 402 (e.g., a TRIAC) is turned off, the transistor 460 is turned off by the voltage divider including the resistors 472, 474 and 476. When the TRIAC light dimmer 402 begins conduction, a delay circuit including the resistors 472 and 474 and the capacitor 462 causes the transistor 460 to remain off, while the resistor 480 dampens an initial surge current. After a delay, the transistor 460 is turned on again, and hence the resistor 480 is shorted.

Though the system 400 often has a better efficiency compared with the system 200, the system 400 still suffers from significant deficiencies. For example, the system 400 usually needs many peripheral devices in order to operate properly. In addition, the cost of the system 400 is often very high.

Hence it is highly desirable to improve the techniques of dimming control.

3. BRIEF SUMMARY OF THE INVENTION

The present invention is directed to integrated circuits. More particularly, the invention provides systems and methods for dimming control with a system controller. Merely by way of example, the invention has been applied to light-emitting-diode (LED) driving systems. But it would be recognized that the invention has a much broader range of applicability.

According to one embodiment, a system for dimming control includes a system controller, a transistor, and a first resistor. The system controller includes a first controller terminal and a second controller terminal. The transistor includes a first transistor terminal, a second transistor terminal and a third transistor terminal. The first resistor includes a first resistor terminal and a second resistor terminal. The first transistor terminal is coupled, directly or indirectly, to the second controller terminal. The first resistor terminal is coupled to the second transistor terminal. The second resistor terminal is coupled to the third transistor terminal. The system controller is configured to receive an input signal at the first controller terminal and to generate an output signal at the second controller terminal based on at least information associated with the input signal. The transistor is configured to receive the output signal at the first transistor terminal and to change between a first condition and a second condition based on at least information associated with the output signal. The system controller is further configured to, if the input signal becomes higher than a threshold, change the output signal after a delay in order to change the transistor from the first condition to the second condition.

According to another embodiment, a system controller for dimming control includes a first controller terminal, and a second controller terminal. The system controller is configured to receive an input signal at the first controller terminal and generate a dimming signal based on at least information associated with the input signal, generate a synchronization signal based on at least information associated with the dimming signal, and output a gate drive signal at the second controller terminal based on at least information associated with the synchronization signal. The system controller is further configured to generate a first pulse of the synchronization signal in response to a first rising edge of the dimming signal, the first pulse including a first falling edge and being associated with a first pulse width, and start changing the gate drive signal between a first logic level and a second logic level for a first burst period at the first falling edge of the pulse.

According to yet another embodiment, a system controller for dimming control includes a first controller terminal and a second controller terminal. The system controller is configured to receive an input signal at the first controller terminal and generate a dimming signal based on at least information associated with the input signal, the dimming signal being associated with a dimming period, and output a gate drive signal at the second controller terminal based on at least information associated with the dimming signal, the gate drive signal being related to a plurality of switching periods included within the dimming period. The plurality of switching periods include a plurality of on-time periods respectively. The system controller is further configured to increase the plurality of on-time periods in duration over time.

In one embodiment, a method for dimming control using at least a system controller including a first controller terminal and a second controller terminal includes receiving an input signal at the first controller terminal, processing information associated with the input signal, and generating an output signal at the second controller terminal based on at least information associated with the input signal in order to change a transistor between a first condition and a second condition, the transistor including a first transistor terminal, a second transistor terminal and a third transistor terminal, the first transistor terminal being coupled, directly or indirectly, to the second controller terminal. In addition, the method includes, if the input signal becomes higher than a threshold, changing the output signal after a delay in order to change the transistor from the first condition to the second condition, and shorting a resistor by the transistor in the second condition, the resistor including a first resistor terminal and a second resistor terminal, the first resistor terminal being coupled to the second transistor terminal, the second resistor terminal being coupled to the third transistor terminal.

In another embodiment, a method for dimming control using at least a system controller including a first controller terminal and a second controller terminal includes receiving an input signal at the first controller terminal, processing information associated with the input signal, and generating a dimming signal based on at least information associated with the input signal. Further, the method includes processing information associated with the dimming signal, generating a synchronization signal based on at least information associated with the dimming signal, processing information associated with the synchronization signal, and outputting a gate drive signal at the second controller terminal based on at least information associated with the synchronization signal. The process for generating a synchronization signal based on at least information associated with the dimming signal includes generating a first pulse of the synchronization signal in response to a first rising edge of the dimming signal, the first pulse including a first falling edge and being associated with a first pulse width. The process for outputting a gate drive signal at the second controller terminal based on at least information associated with the synchronization signal includes starting changing the gate drive signal between a first logic level and a second logic level for a first burst period at the first falling edge of the pulse.

In yet another embodiment, a method for dimming control using at least a system controller including a first controller terminal and a second controller terminal includes receiving an input signal at the first controller terminal, processing information associated with the input signal, and generating a dimming signal based on at least information associated with the input signal, the dimming signal being associated with a dimming period. In addition, the method includes processing information associated with the dimming signal, and outputting a gate drive signal at the second controller terminal based on at least information associated with the dimming signal, the gate drive signal being related to a plurality of switching periods included within the dimming period. The plurality of switching periods include a plurality of on-time periods respectively. The plurality of on-time periods increase in duration over time.

Many benefits are achieved by way of the present invention over conventional techniques. For example, some embodiments of the present invention implement a system controller and its peripheral circuits to detect changes of an input signal and generate a signal to drive a switch to connect or short a power resistor for active damping control. In another example, certain embodiments of the present invention synchronize a gate drive signal output to a switch with a dimming signal that indicates when a light dimmer is turned on to regulate power delivered to LEDs to keep LED currents approximately constant at a predetermined level. In yet another example, some embodiments of the present invention adopt a soft control scheme to gradually increase the duty cycle of a gate drive signal to a switch so as to increase gradually a current flowing through the switch to reduce instant current strike to the switch when a light dimmer is turned on.

Depending upon embodiment, one or more benefits may be achieved. These benefits and various additional objects, features and advantages of the present invention can be fully appreciated with reference to the detailed description and accompanying drawings that follow.

4. BRIEF DESCRIPTION OF THE DRAWINGS

5. DETAILED DESCRIPTION OF THE INVENTION

The present invention is directed to integrated circuits. More particularly, the invention provides systems and methods for dimming control with a system controller. Merely by way of example, the invention has been applied to light-emitting-diode (LED) driving systems. But it would be recognized that the invention has a much broader range of applicability.

Figure 1:
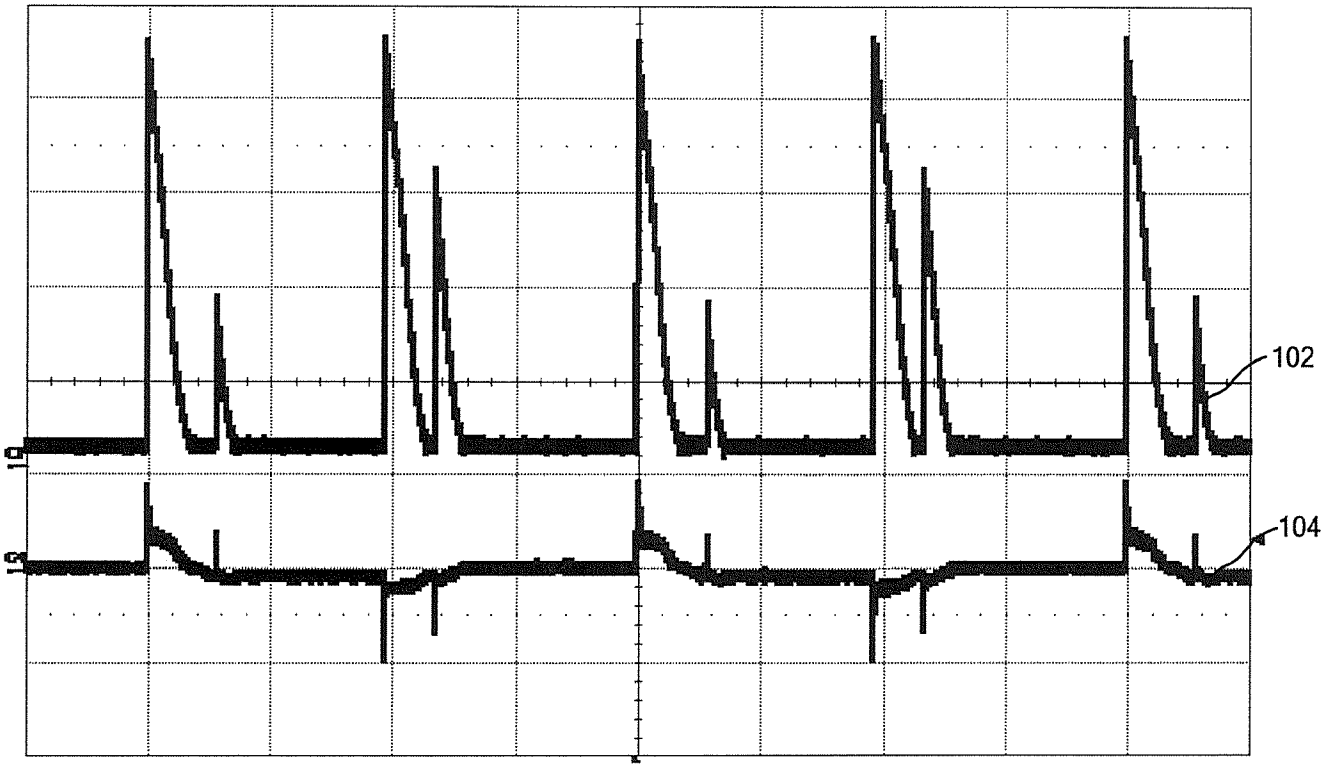
Fig. 1 Prior Art
FIG. 1 shows simplified signal waveforms of a conventional light dimmer that is connected to capacitive loads.
Figure 2:
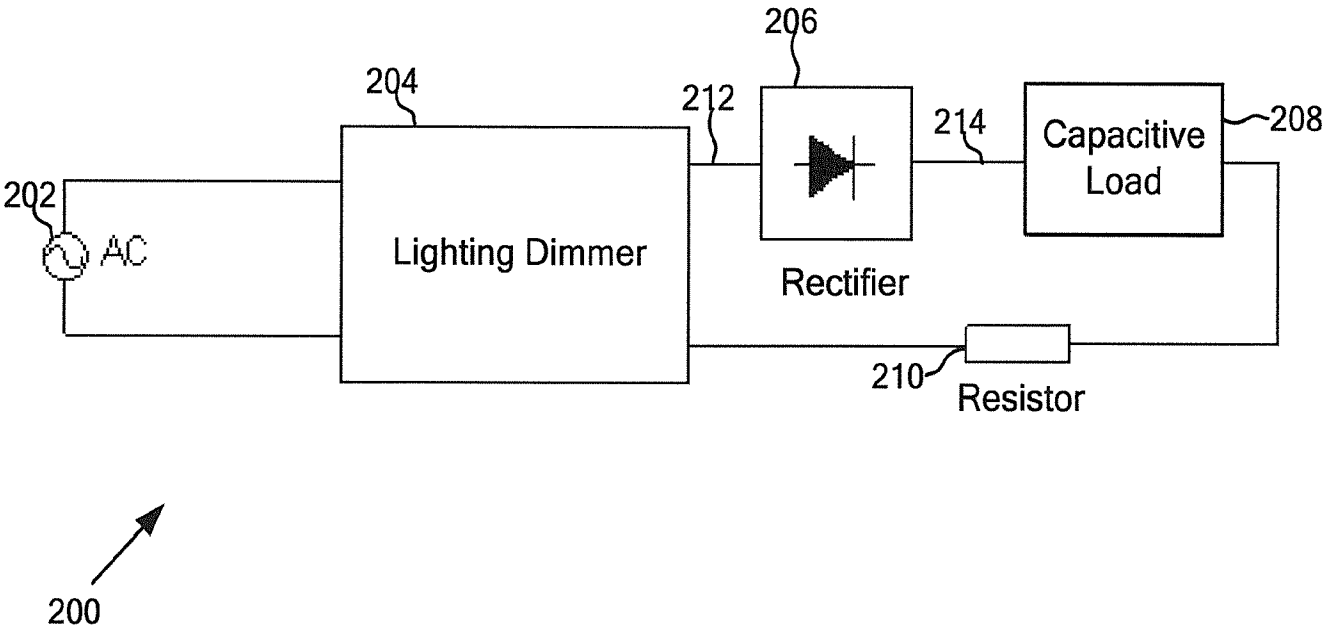
Fig. 2 Prior Art
FIG. 2 is a simplified diagram showing a conventional light dimmer system.
Figure 3:
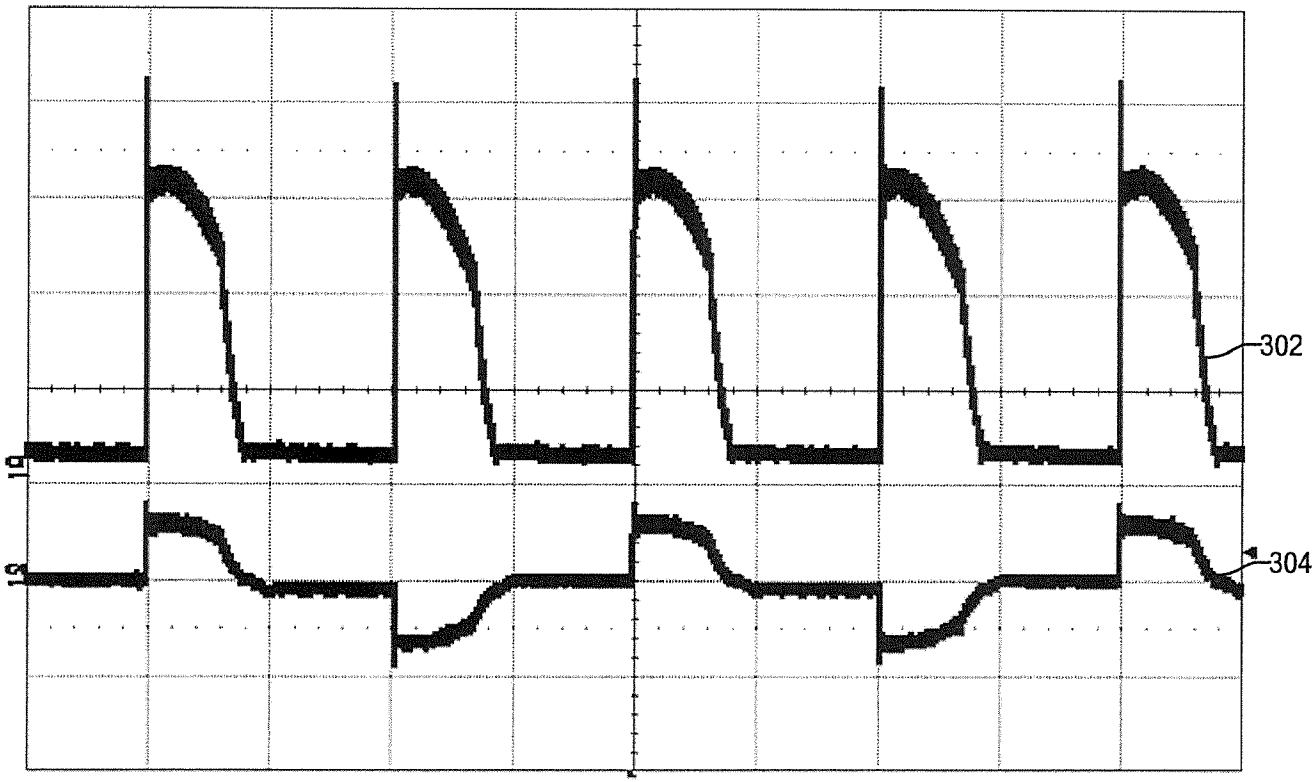
Fig. 3 Prior Art
FIG. 3 shows simplified conventional signal waveforms of the light dimmer system shown in FIG. 2.
Figure 4:
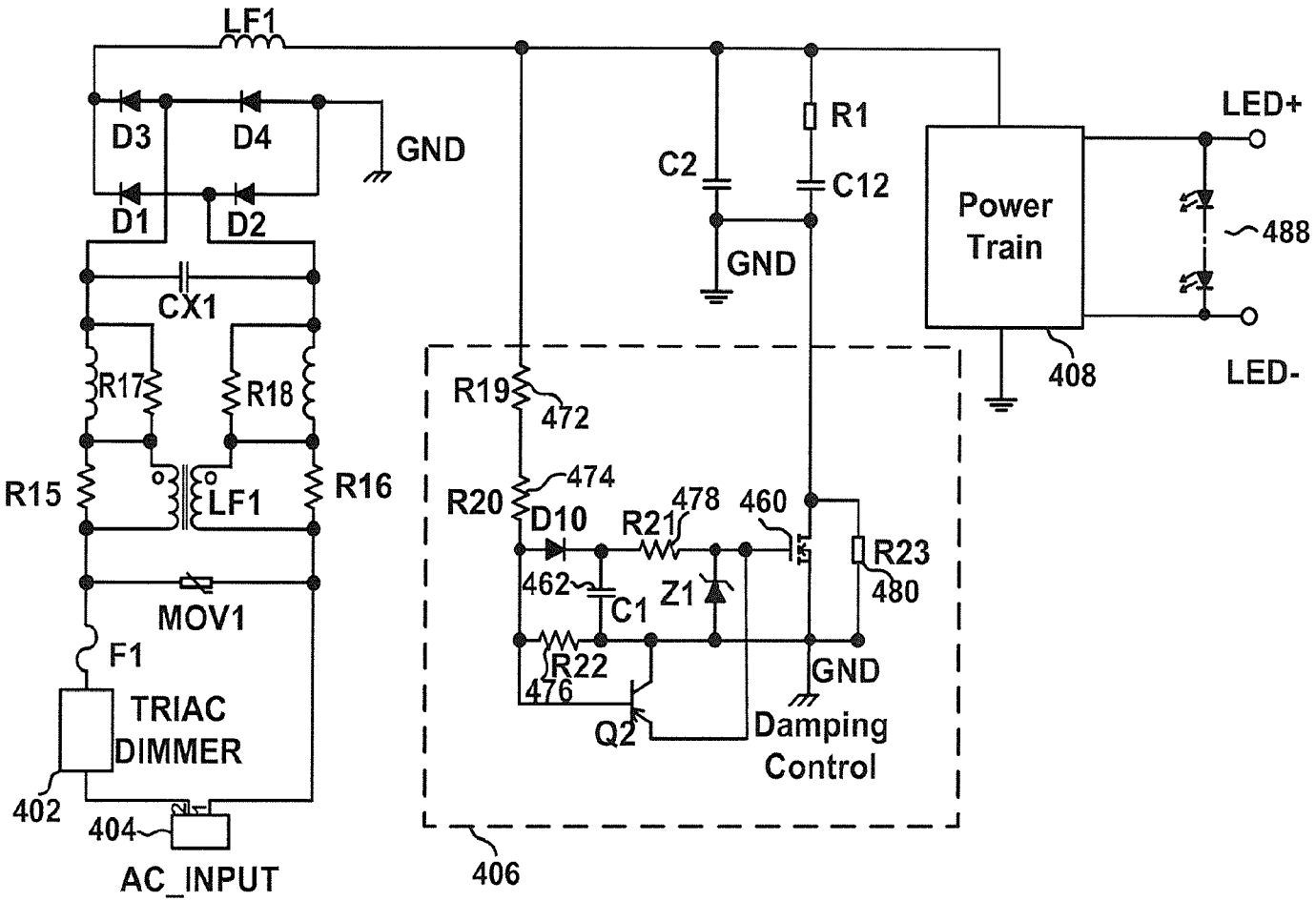
Fig. 4 Prior Art
FIG. 4 is a simplified diagram showing a conventional system for dimming control.
Figure 5:
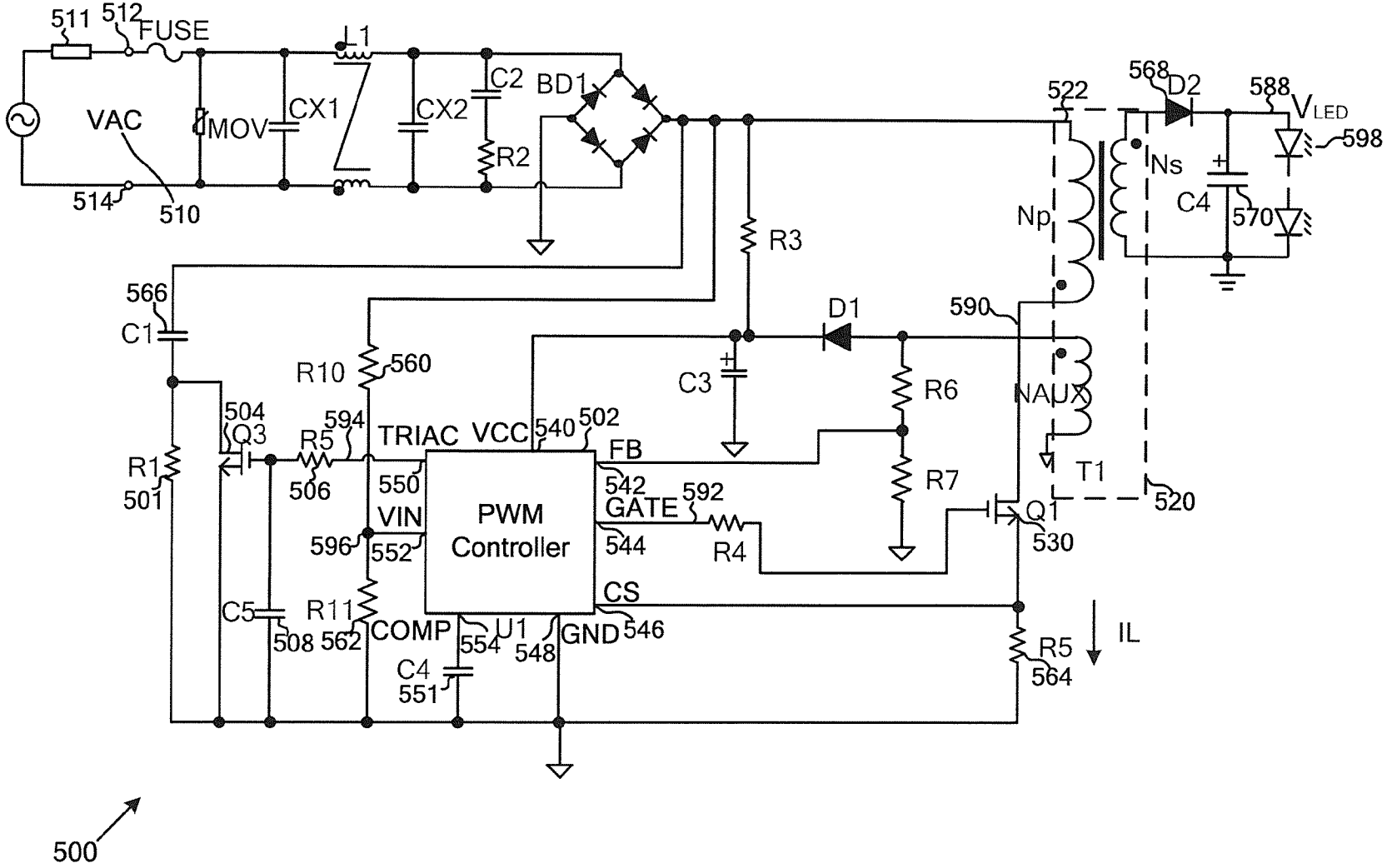
FIG. 5 is a simplified diagram showing a system for dimming control according to an embodiment of the present invention.

FIG. 5 is a simplified diagram showing a system for dimming control according to an embodiment of the present invention. This diagram is merely an example, which should not unduly limit the scope of the claims. One of ordinary skill in the art would recognize many variations, alternatives, and modifications. The system 500 includes a light dimmer 511, input terminals 512 and 514, a system controller 502, resistors 501, 506, 560, 562, 564, capacitors 508, 551, 566 and 570, switches 504 and 530, a transformer 520, a rectifying diode 568, and LEDs 598. For example, the system controller 502 includes terminals 540, 542, 544, 546, 548, 550, 552 and 554. In another example, the switch 504 is a transistor. In yet another example, the switch 530 is a transistor. As shown in FIG. 5, a fly-back structure is implemented as an example.

According to one embodiment, when the light dimmer 511 (e.g., a TRIAC) is turned on, an AC input 510 (e.g., VAC) is provided to the input terminals 512 and 514. For example, at the terminal 552 (e.g., VIN), the system controller 502 receives an input signal 596 related to the AC input 510 from a voltage divider including the resistors 560 and 562. In another example, in response, the system controller 502 generates one or more control signals (e.g., a control signal 594 from the terminal 550) to affect operating status of the switch 504 and the resistor 501. In yet another example, the switch 504 and the resistor 501 are connected in parallel. In yet another example, in response to the control signal 594 from the terminal 550 (e.g., terminal TRIAC), the switch 504 is open (e.g., off), allowing the resistor 501 to dampen initial current surge to one or more capacitive loads. In yet another example, after the light dimmer 511 conducts for a predetermined period of time, the switch 504 is closed (e.g., on) in response to the control signal 594 from the terminal 550 (e.g., terminal TRIAC), thus shorting the resistor 501 in order to improve the system efficiency. In yet another example, the resistor 506 and the capacitor 508 reduce current strikes to the switch 504 when the switch 504 is turned on or off. In yet another example, the system controller 502 outputs a gate-drive signal 592 to the switch 530. In yet another example, in response, the switch 530 is turned on or off to affect a current 590 that flows through a primary winding 522 of the transformer 520 in order to regulate a current 588 that flows through the LEDs 598.

Figure 6:
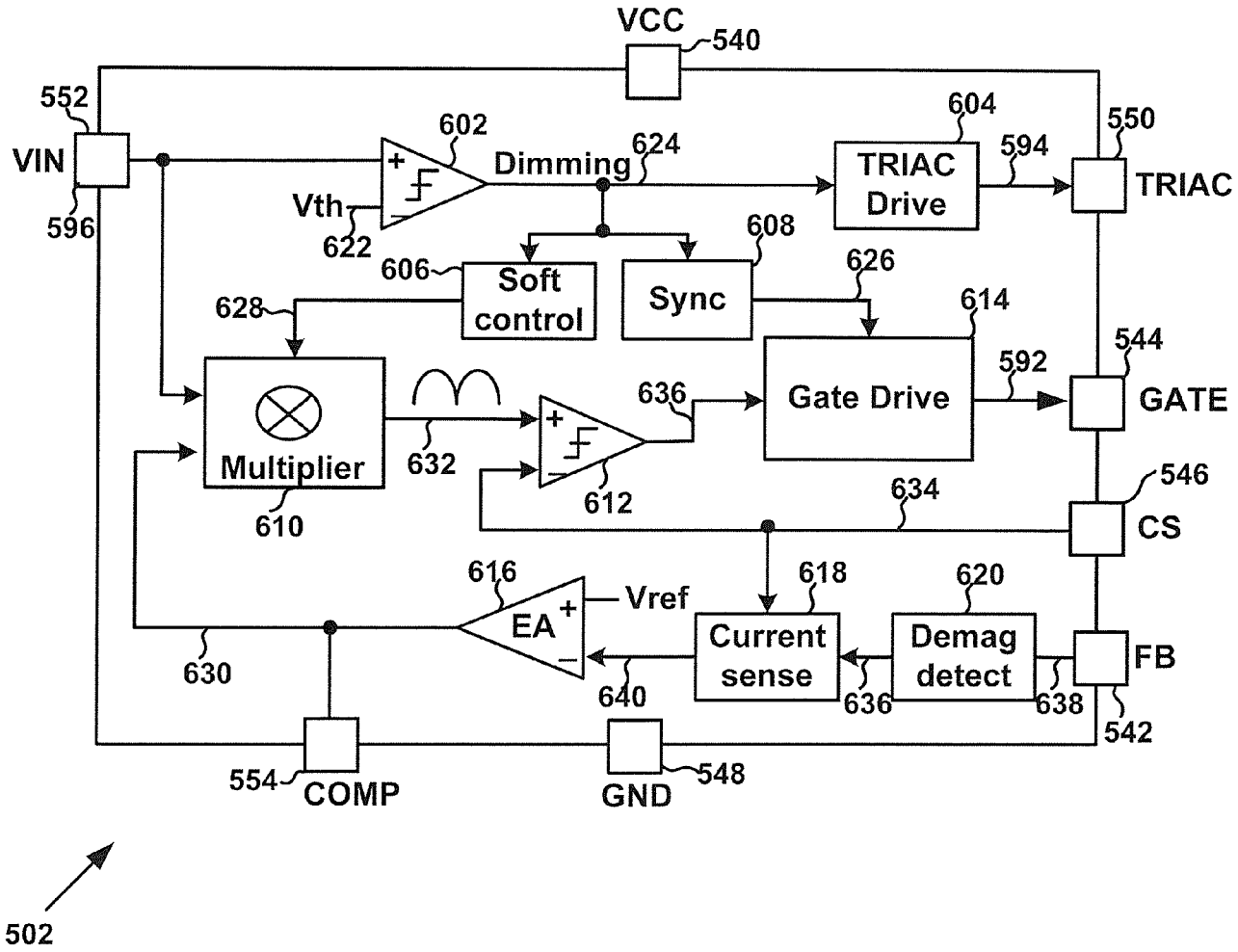
FIG. 6 is a simplified diagram showing the system controller as part of the system shown in FIG. 5 according to an embodiment of the present invention.

FIG. 6 is a simplified diagram showing the system controller 502 as part of the system 500 according to an embodiment of the present invention. This diagram is merely an example, which should not unduly limit the scope of the claims. One of ordinary skill in the art would recognize many variations, alternatives, and modifications. The system controller 502 includes comparators 602 and 612, a signal generator 604, a soft control component 606, a synchronization component 608, a multiplier 610, a gate driver 614, an error amplifier 616, a current sensing component 618, and a demagnetization detector 620.

In one embodiment, the system controller 502 receives the input signal 596 in order to detect the change of the AC input 510. For example, the comparator 602 receives the input signal 596 and a threshold signal 622, and generates a dimming signal 624. In another example, the signal generator 604 receives the dimming signal 624 and generates the control signal 594 to drive the switch 504. In yet another example, the synchronization component 608 also receives the dimming signal 624 and outputs a synchronization signal 626 to the gate driver 614 which generates the gate-drive signal 592 to drive the switch 530. In yet another example, the soft control component 606 receives the dimming signal 624 and generates a signal 628 which is received by the multiplier 610.

In another embodiment, the multiplier 610 also receives the input signal 596 and an amplified signal 630 from the error amplifier 616 and outputs a signal 632. For example, the comparator 612 receives the signal 632 and a current sensing signal 634 that indicates the current 590 flowing through the primary winding 522, and outputs a comparison signal 636 to the gate driver 614 in order to affect the status of the switch 530.

In yet another embodiment, the demagnetization component 620 receives a feedback signal 638 to detect when a demagnetization process associated with the secondary side of the transformer 520 ends, and outputs a demagnetization signal 636 to the current sensing component 618 in order to affect the sampling and/or holding of the current sensing signal 634. For example, the error amplifier 616 receives a signal 640 from the current sensing component 618, and an output terminal of the error amplifier 616 is connected to the capacitor 551 through the terminal 554 (e.g., COMP) in order to keep the system 500 stable.

Figure 7:
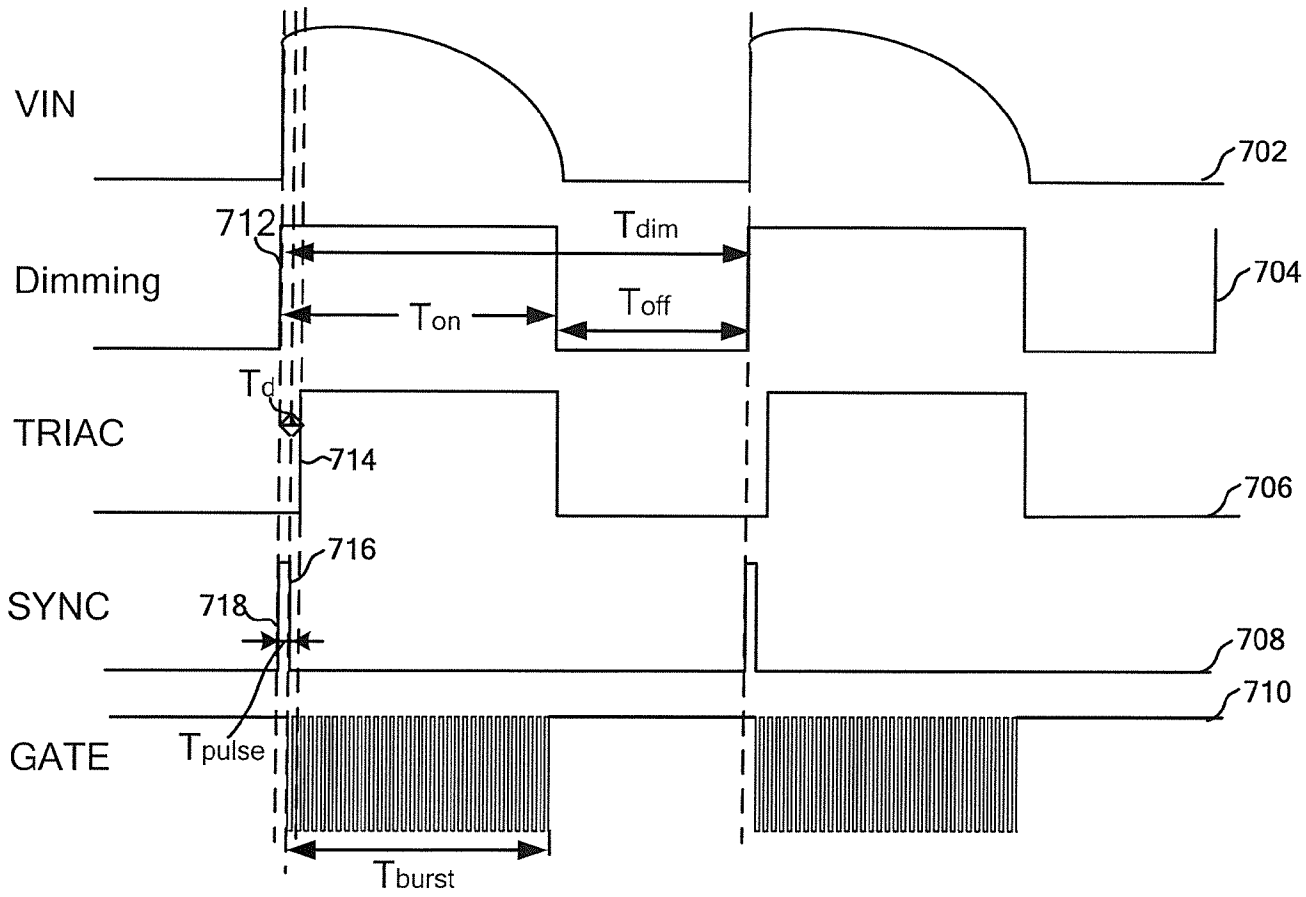
FIG. 7 shows simplified timing diagrams for the system controller as part of the system shown in FIG. 5 according to an embodiment of the present invention.

FIG. 7 shows simplified timing diagrams for the system controller 502 as part of the system 500 according to an embodiment of the present invention. These diagrams are merely examples, which should not unduly limit the scope of the claims. One of ordinary skill in the art would recognize many variations, alternatives, and modifications. The waveform 702 represents the input signal 596 as a function of time, the waveform 704 represents the dimming signal 624 as a function of time, and the waveform 706 represents the control signal 594 as a function of time. In addition, the waveform 708 represents the synchronization signal 626 as a function of time, and the waveform 710 represents the gate-drive signal 592 as a function of time.

Referring back to FIG. 5, the system controller 502 outputs the gate-drive signal 592 to drive the switch 530 in order to regulate the current 588 flowing through the LEDs 598, in some embodiments. For example, when the light dimmer 511 is turned on, the system 500 receives the AC input 510 that is not zero, and the system controller 502 generates the gate-drive signal 592 to drive the switch 530 in order to deliver power to the LEDs 598. In another example, when the light dimmer 511 is turned off, the AC input 510 has a very low magnitude (e.g., zero), and little power would be transferred to the LEDs 598.

Though the light dimmer 511 can adjust a ratio between the time period when the light dimmer 511 is on and the time period when the light dimmer 511 is off, the light dimmer 511 cannot regulate the power delivered to the LEDs 598 during the time period when the light dimmer 511 is on according to certain embodiments. For example, if power delivered to the LEDs 598 is not approximately constant over time, the output current 588 would be fluctuating, which may cause the LEDs 598 to flicker, particularly when the on-time period is relatively short. Hence, the system controller 502 is used to regulate the output power during the time period when the light dimmer 511 is on in some embodiments.

In one embodiment, as shown in FIG. 6, the comparator 602 generates the dimming signal 624 based on the input signal 596 and the threshold signal 622, and the dimming signal 624 is associated with a dimming period. In another example, if the dimming signal 624 is at a logic high level, it indicates that the light dimmer 511 is on. In yet another example, if the dimming signal 624 is at a logic low level, it indicates that the light dimmer 511 is off. Hence, a rising edge of the dimming signal 624 corresponds to a time at which the light dimmer 511 is turned on (e.g., as shown by the waveforms 702 and 704) according to certain embodiments. For example, a dimming period associated with the dimming signal 624 (e.g., $T_{dim}$) corresponds to a period associated with the input signal 596. In another example, the dimming period (e.g., $T_{dim}$) includes an on-time period (e.g., $T_{on}$) and an off-time period (e.g., $T_{off}$) as shown by the waveform 704.

In another embodiment, as shown in FIG. 7, the synchronization component 608 generates a pulse 718 of the synchronization signal 626 in response to a rising edge 712 of the dimming signal 624 as shown by the waveforms 704 and 708. For example, the pulse 718 includes a falling edge 716 and is associated with a pulse width (e.g., $T_{pulse}$). In another example, a rising edge 714 of the control signal 594 appears a delay (e.g., $T_d$) after the rising edge 712 of the dimming signal 624 (e.g., as shown by the waveforms 704 and 706). That is, the switch 504 is closed (e.g., on) a delay (e.g., $T_d$) after the rising edge 712 of the dimming signal 624, as an example. In yet another example, the gate driver 614 begins to change the gate-drive signal 592 between a logic high level and a logic low level for a burst period (e.g., $T_{burst}$) at the falling edge 716 of the pulse 718 (e.g., as shown by the waveform 710). In yet another example, the burst period within each dimming period is approximately the same in duration. The duty cycle and the frequency of the gate-drive signal 592 are kept approximately the same in different dimming periods of the dimming signal 626. That is, the gate-drive signal 592 is synchronized with the dimming signal 624 through the synchronization signal 626, as an example. Thus, during each dimming period, output power is kept approximately the same and the current 588 that flows through the LEDs 598 is kept approximately constant according to certain embodiments.

As shown in FIG. 7, a leading edge of the input signal 596 (e.g., VIN) during an on-time period (e.g., $T_{on}$) is removed because the light dimmer 511 is a leading edge light dimmer according to certain embodiments. For example, when the light dimmer 511 is turned on, a significant voltage change occurs, and correspondingly the peak value of the output current 588 changes significantly. In another example, the switch 530 receives a strike of a large instant current, and such a large instant current (e.g., a sudden change of output load) may distort the waveform of the input signal 596 (e.g., oscillation). A soft control scheme is implemented in some embodiments to reduce the current strike to the switch 530 when the light dimmer 511 is turned on.

Figure 8:
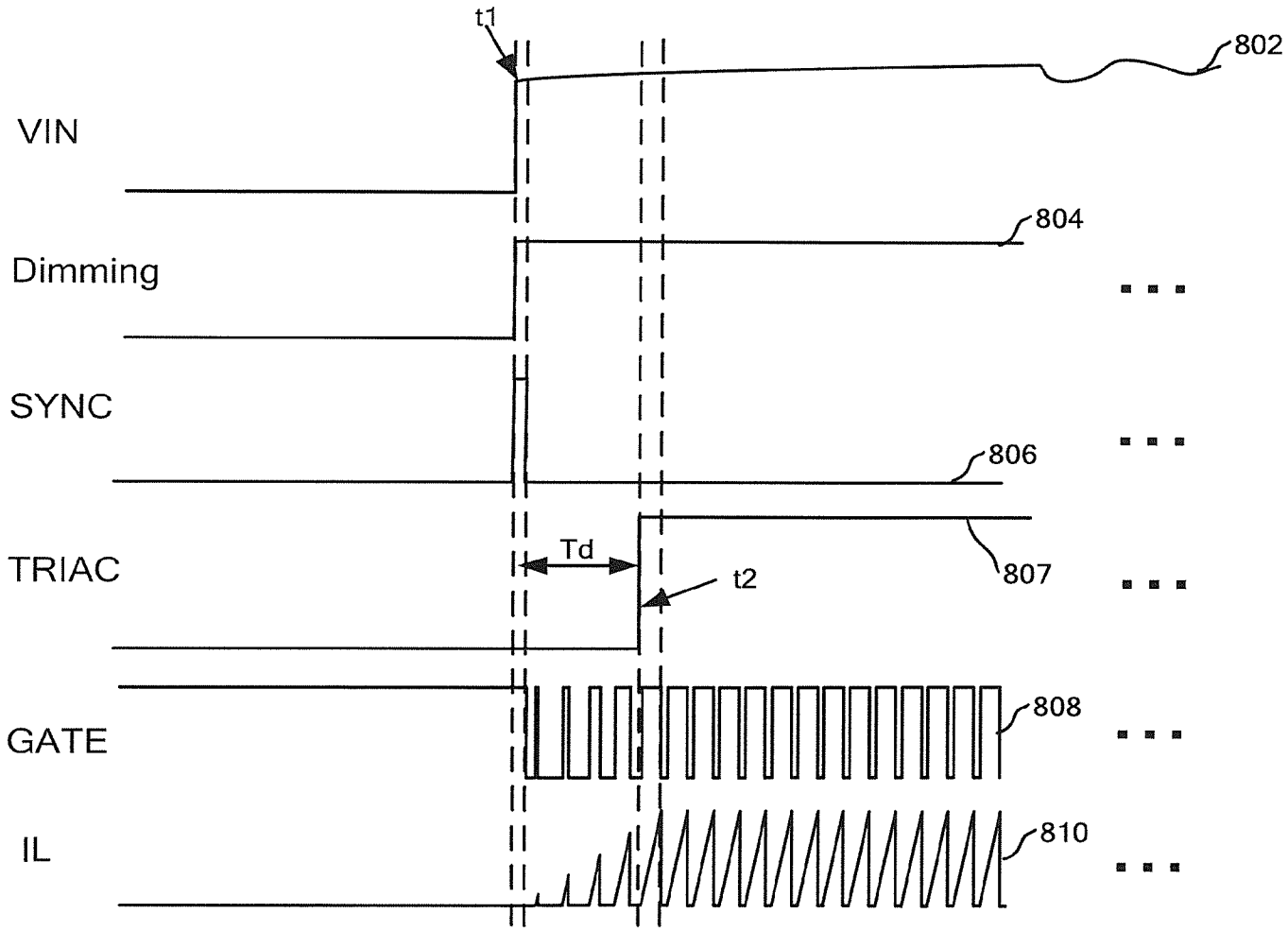
FIG. 8 shows simplified timing diagrams for the system controller as part of the system shown in FIG. 5 according to another embodiment of the present invention.

FIG. 8 shows simplified timing diagrams for the system controller 502 as part of the system 500 according to another embodiment of the present invention. These diagrams are merely examples, which should not unduly limit the scope of the claims. One of ordinary skill in the art would recognize many variations, alternatives, and modifications. The waveform 802 represents the input signal 596 as a function of time, the waveform 804 represents the dimming signal 624 as a function of time, and the waveform 806 represents the synchronization signal 626 as a function of time. In addition, the waveform 807 represents the control signal 594 as a function of time, the waveform 808 represents the gate-drive signal 592 as a function of time, and the waveform 810 represents the current 590 that flows through the switch 530 as a function of time.

As shown in FIG. 8, a rising edge of the dimming signal 624 corresponds to the time at which the light dimmer 511 is turned on (e.g., $t_1$ as shown by the waveforms 802 and 804) according to certain embodiments. For example, the synchronization component 608 generates a pulse in the synchronization signal 626 corresponding to the rising edge of the dimming signal 624 (e.g., as shown by the waveforms 804 and 806). In another example, a rising edge of the control signal 594 appears a delay (e.g., $T_d$) after the rising edge of the dimming signal 624 (e.g., as shown by the waveforms 804 and 807). That is, the switch 504 is closed (e.g., on) at time $t_2$, as an example.

Referring to FIG. 6, the soft control component 606 receives the dimming signal 624 and outputs the signal 628 to the multiplier 610 in some embodiments. For example, the multiplier 610 also receives the input signal 596 and the amplified signal 630 and outputs the signal 632 to the comparator 612 that generates a comparison signal 636. In another example, the gate driver 614 receives the comparison signal 636 and the synchronization signal 626 and outputs the gate-drive signal 592.

In another embodiment, when the light dimmer 511 is turned on, the soft control component 606 changes the signal 628 to affect the gate-drive signal 592 so that the duty cycle of the gate-drive signal 592 is gradually increased over time (e.g., as shown by the waveform 808). For example, peak values of the current 590 that flows through the switch 530 increases gradually (e.g., as shown by the waveform 810). Thus, the instant current strike on the switch 530 when the light dimmer 511 is turned on is reduced according to certain embodiments.

As discussed above, and further emphasized here, FIGS. 5, 6, 7 and 8 are merely examples, which should not unduly limit the scope of the claims. One of ordinary skill in the art would recognize many variations, alternatives, and modifications. For example, a system controller can be implemented in a BUCK structure to achieve similar schemes as shown in FIGS. 5, 6, 7 and 8.

Figure 9:
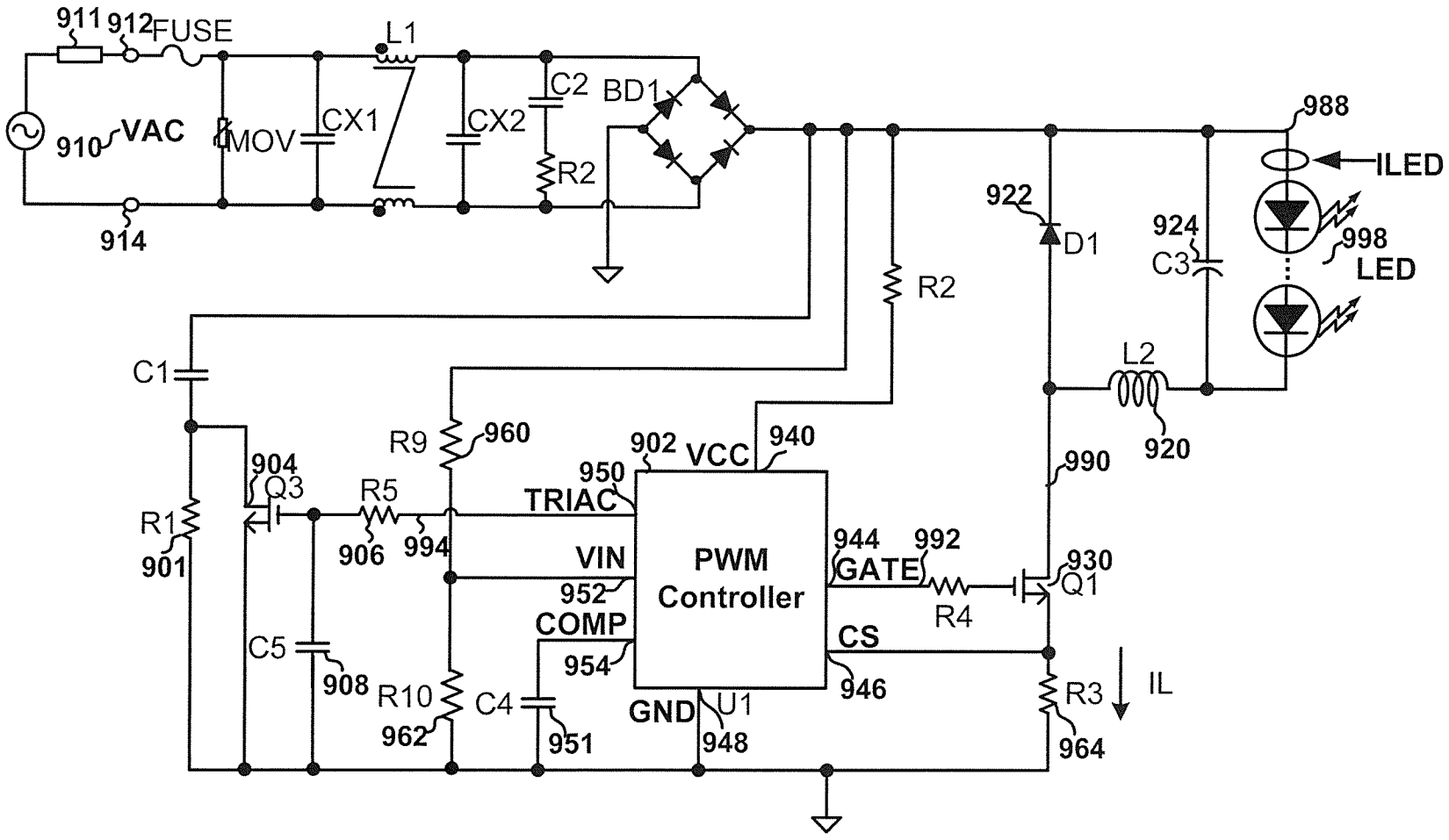
FIG. 9 is a simplified diagram showing a system for dimming control according to another embodiment of the present invention.

FIG. 9 is a simplified diagram showing a system for dimming control according to another embodiment of the present invention. This diagram is merely an example, which should not unduly limit the scope of the claims. One of ordinary skill in the art would recognize many variations, alternatives, and modifications. The system 900 includes a light dimmer 911, input terminals 912 and 914, a system controller 902, resistors 901, 906, 960, 962 and 964, capacitors 908 and 924, switches 904 and 930, an inductor 920, a diode 922, and LEDs 998. For example, the system controller 902 includes terminals 940, 944, 946, 948, 950, 952 and 954. In another example, the system controller 902 is the same as the system controller 502.

According to one embodiment, when the light dimmer 911 (e.g., a TRIAC) is turned on, an AC input 910 (e.g., VAC) is provided to the input terminals 912 and 914. For example, at the terminal 952 (e.g., VIN), the system controller 902 receives an input signal 996 from a voltage divider including the resistors 960 and 962. In another example, in response, the system controller 902 generates one or more control signals (e.g., a signal 994 from the terminal 950) to affect operating status of the switch 904 and the resistor 901. In yet another example, the switch 904 and the resistor 901 are connected in parallel. In yet another example, in response to the signal 994 from the terminal 950 (e.g., terminal TRIAC), the switch 904 is open (e.g., off), allowing the resistor 901 to dampen initial current surge to one or more capacitive loads. In yet another example, after the light dimmer 911 conducts for a predetermined period of time, the switch 904 is closed (e.g., on) in response to the signal 994 from the terminal 950 (e.g., terminal TRIAC), thus shorting the resistor 901 in order to improve the system efficiency. In yet another example, the system controller 902 outputs a gate-drive signal 992 to the switch 930. In yet another example, in response, the switch 930 is turned on or off in order to regulate a current 988 that flows through the LEDs 998.

Figure 10:
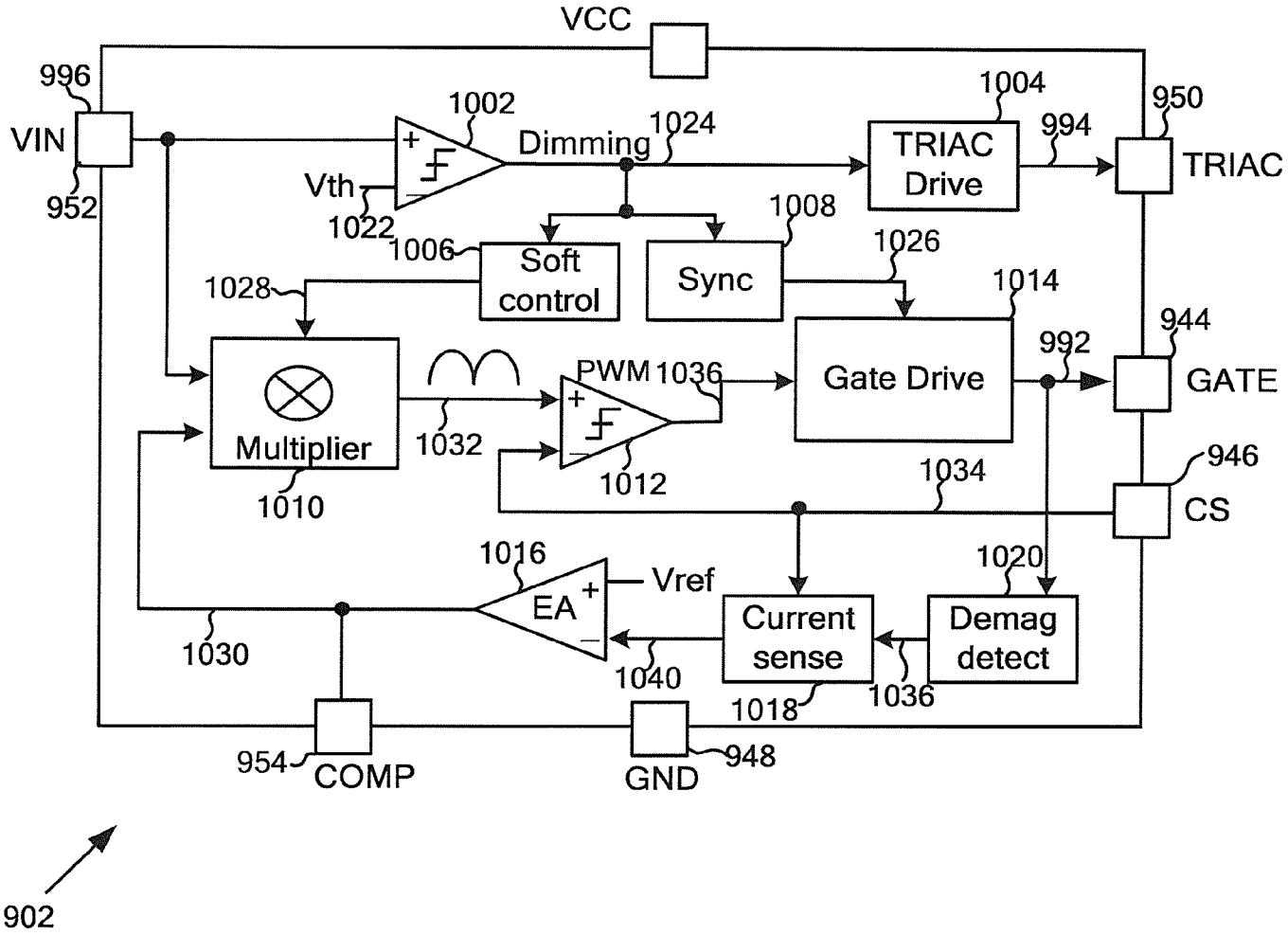
FIG. 10 is a simplified diagram of the system controller as part of the system shown in FIG. 9 according to an embodiment of the present invention.

FIG. 10 is a simplified diagram of the system controller 902 as part of the system 900 according to an embodiment of the present invention. This diagram is merely an example, which should not unduly limit the scope of the claims. One of ordinary skill in the art would recognize many variations, alternatives, and modifications. The system controller 902 includes comparators 1002 and 1012, a signal generator 1004, a soft control component 1006, a synchronization component 1008, a multiplier 1010, a gate driver 1014, an error amplifier 1016, a current sensing component 1018, and a demagnetization detector 1020.

In one embodiment, the system controller 902 receives the input signal 996 in order to detect the change of the AC input 910. For example, the comparator 1002 receives the input signal 996 and a threshold signal 1022, and generates a dimming signal 1024. In another example, the signal generator 1004 receives the dimming signal 1024 and generates the control signal 994 to drive the switch 904. In yet another example, the synchronization component 1008 also receives the dimming signal 1024 and outputs a synchronization signal 1026 to the gate driver 1014 which generates the gate-drive signal 992 to drive the switch 930. In yet another example, the soft control component 1006 receives the dimming signal 1024 and outputs a signal 1028 to the multiplier 1010.

In another embodiment, the multiplier 1010 also receives the input signal 996 and an amplified signal 1030 from the error amplifier 1016, and outputs a signal 1032. For example, the comparator 1012 receives the signal 1032 and a current sensing signal 1034 that indicates the current 990 flowing through the switch 930, and outputs a comparison signal 1036 to the gate driver 1014 in order to affect the status of the switch 930.

In yet another embodiment, the demagnetization component 1020 receives the gate-drive signal 992 and detects when a demagnetization process of the inductor 920 ends using a parasitic capacitance associated with the switch 930. For example, the demagnetization component 1020 outputs a demagnetization signal 1036 to the current sensing component 1018 in order to affect the sampling and/or holding of the current sensing signal 1034. For example, the error amplifier 1016 receives a signal 1040 from the current sensing component 1018, and an output terminal of the error amplifier 1016 is connected to the capacitor 951 through the terminal 954 (e.g., COMP) to keep the system 900 stable.

As discussed above, and further emphasized here, FIG. 9 is merely an example, which should not unduly limit the scope of the claims. One of ordinary skill in the art would recognize many variations, alternatives, and modifications. For example, peripheral circuits, instead of the parasitic capacitance associated with the switch 930, can be used for detecting when the demagnetization process of the inductor 920 ends as shown in FIG. 11.

Figure 11:
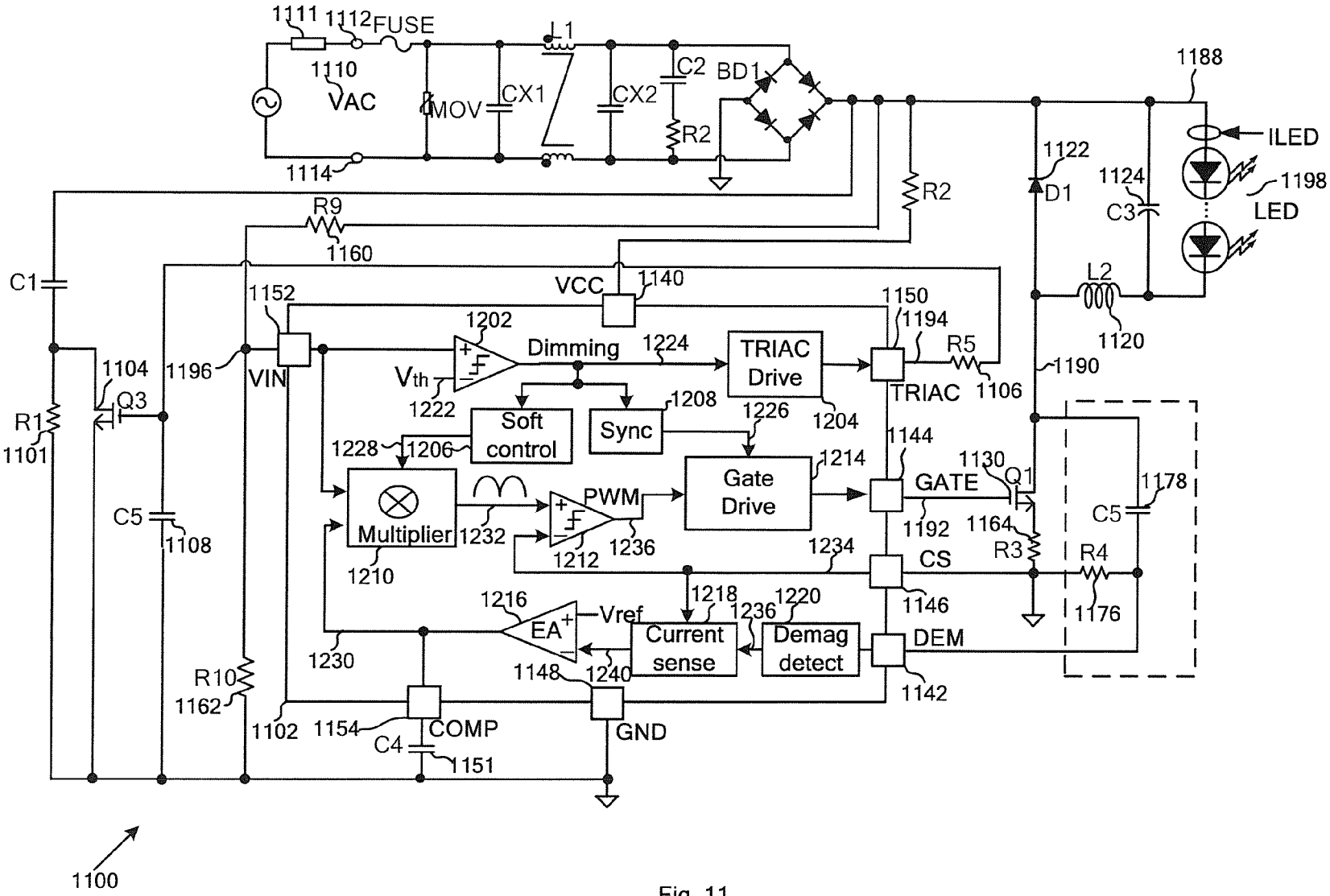
FIG. 11 is a simplified diagram showing a system for dimming control according to yet another embodiment of the present invention.

FIG. 11 is a simplified diagram showing a system for dimming control according to yet another embodiment of the present invention. This diagram is merely an example, which should not unduly limit the scope of the claims. One of ordinary skill in the art would recognize many variations, alternatives, and modifications. The system 1100 includes a light dimmer 1111, input terminals 1112 and 1114, a system controller 1102, resistors 1101, 1106, 1160, 1162, 1164 and 1176, capacitors 1108, 1124 and 1178, switches 1104 and 1130, an inductor 1120, a diode 1122, and LEDs 1198. The system controller 1102 includes comparators 1202 and 1212, a signal generator 1204, a soft control component 1206, a synchronization component 1208, a multiplier 1210, a gate driver 1214, an error amplifier 1216, a current sensing component 1218, and a demagnetization detector 1220. In addition, the system controller 1102 includes terminals 1140, 1142, 1144, 1146, 1148, 1150, 1152 and 1154. For example, the system controller 1102 is the same as the system controller 502.

According to one embodiment, when the light dimmer 1111 (e.g., a TRIAC) is turned on, an AC input 1110 (e.g., VAC) is provided to the input terminals 1112 and 1114. For example, at the terminal 1152 (e.g., VIN), the system controller 1102 receives an input signal 1196 from a voltage divider including the resistors 1160 and 1162. In another example, in response, the system controller 1102 generates one or more control signals (e.g., a signal 1194 from the terminal 1150) to affect operating status of the switch 1104 and the resistor 1101. In yet another example, the switch 1104 and the resistor 1101 are connected in parallel. In yet another example, in response to the signal 1194 from the terminal 1150 (e.g., terminal TRIAC), the switch 1104 is open (e.g., off), allowing the resistor 1101 to dampen initial current surge to one or more capacitive loads. In yet another example, after the light dimmer conducts for a predetermined period of time, the switch 1104 is closed (e.g., on) in response to the signal 1194 from the terminal 1150 (e.g., terminal TRIAC), thus shorting the resistor 1101 in order to improve the system efficiency. In yet another example, the system controller 1102 outputs a gate-drive signal 1192 to drive the switch 1130. In yet another example, in response, the switch 1130 is turned on or off in order to regulate a current 1188 that flows through the LEDs 1198.

According to another embodiment, the system controller 1102 receives the input signal 1196 at the terminal 1152 (e.g., terminal VIN). For example, the comparator 1202 receives the input signal 1196 and a threshold signal 1222, and generates a dimming signal 1224. In another example, the signal generator 1204 receives the dimming signal 1224 and generates the control signal 1194 to drive the switch 1104. In yet another example, the synchronization component 1208 also receives the dimming signal 1224 and outputs a synchronization signal 1226 to the gate driver 1214 which generates the gate-drive signal 1192 to drive the switch 1130. In yet another example, the soft control component 1206 receives the dimming signal 1224 and generates a signal 1228 to the multiplier 1210.

According to yet another embodiment, the multiplier 1210 also receives the input signal 1196 and an amplified signal 1230 from the error amplifier 1216, and outputs a signal 1232. For example, the comparator 1212 receives the signal 1232 and a current sensing signal 1234 that indicates the current 1190 flowing through the primary winding 1122, and outputs a comparison signal 1236 to the gate driver 1214 in order to affect the status of the switch 1130.

A demagnetization detection circuit including the resistor 1176 and the capacitor 1178 is used for detecting when the demagnetization process of the inductor 1120 ends, instead of using a parasitic capacitance associated with the switch 1130 in some embodiments. For example, when the demagnetization process of the inductor 1120 ends, the voltage change of the inductor 1120 is coupled to the terminal 1142 (e.g., terminal DEM) through at least the capacitor 1178. In another example, the demagnetization component 1220 detects the voltage change of the inductor 1120 and outputs a demagnetization signal 1236 to the current sensing component 1218 in order to affect the sampling and/or holding of a current sensing signal 1234 which indicates a current 1190 flowing through the switch 1130. In yet another example, the error amplifier 1216 receives a signal 1240 from the current sensing component 1218, and an output terminal of the error amplifier 1216 is connected to the capacitor 1151 through the terminal 1154 (e.g., COMP) to keep the system 1100 stable.

In some embodiments, the schemes shown in FIG. 7 and/or FIG. 8 apply to the system controller 902 as part of the system 900 and/or the system controller 1102 as part of the system 1100. For example, the system controller 902 as part of the system 900 has similar timing diagrams as shown in FIG. 7 and/or FIG. 8. In another example, the system controller 1102 as part of the system 1100 has similar timing diagrams as shown in FIG. 7 and/or FIG. 8.

According to another embodiment, a system for dimming control includes a system controller, a transistor, and a first resistor. The system controller includes a first controller terminal and a second controller terminal. The transistor includes a first transistor terminal, a second transistor terminal and a third transistor terminal. The first resistor includes a first resistor terminal and a second resistor terminal. The first transistor terminal is coupled, directly or indirectly, to the second controller terminal. The first resistor terminal is coupled to the second transistor terminal. The second resistor terminal is coupled to the third transistor terminal. The system controller is configured to receive an input signal at the first controller terminal and to generate an output signal at the second controller terminal based on at least information associated with the input signal. The transistor is configured to receive the output signal at the first transistor terminal and to change between a first condition and a second condition based on at least information associated with the output signal. The system controller is further configured to, if the input signal becomes higher than a threshold, change the output signal after a delay in order to change the transistor from the first condition to the second condition. For example, the system is implemented according to at least FIG. 5, FIG. 9 and/or FIG. 11.

According to another embodiment, a system controller for dimming control includes a first controller terminal, and a second controller terminal. The system controller is configured to receive an input signal at the first controller terminal and generate a dimming signal based on at least information associated with the input signal, generate a synchronization signal based on at least information associated with the dimming signal, and output a gate drive signal at the second controller terminal based on at least information associated with the synchronization signal. The system controller is further configured to generate a first pulse of the synchronization signal in response to a first rising edge of the dimming signal, the first pulse including a first falling edge and being associated with a first pulse width, and start changing the gate drive signal between a first logic level and a second logic level for a first burst period at the first falling edge of the pulse. For example, the system controller is implemented according to FIG. 5, FIG. 6, FIG. 7, FIG. 8, FIG. 9, FIG. 10 and/or FIG. 11.

According to yet another embodiment, a system controller for dimming control includes a first controller terminal and a second controller terminal. The system controller is configured to receive an input signal at the first controller terminal and generate a dimming signal based on at least information associated with the input signal, the dimming signal being associated with a dimming period, and output a gate drive signal at the second controller terminal based on at least information associated with the dimming signal, the gate drive signal being related to a plurality of switching periods included within the dimming period. The plurality of switching periods include a plurality of on-time periods respectively. The system controller is further configured to increase the plurality of on-time periods in duration over time. For example, the system controller is implemented according to FIG. 5, FIG. 6, FIG. 7, FIG. 8, FIG. 9, FIG. 10 and/or FIG. 11.

In another embodiment, a method for dimming control using at least a system controller including a first controller terminal and a second controller terminal includes receiving an input signal at the first controller terminal, processing information associated with the input signal, and generating an output signal at the second controller terminal based on at least information associated with the input signal in order to change a transistor between a first condition and a second condition, the transistor including a first transistor terminal, a second transistor terminal and a third transistor terminal, the first transistor terminal being coupled, directly or indirectly, to the second controller terminal. In addition, the method includes, if the input signal becomes higher than a threshold, changing the output signal after a delay in order to change the transistor from the first condition to the second condition, and shorting a resistor by the transistor in the second condition, the resistor including a first resistor terminal and a second resistor terminal, the first resistor terminal being coupled to the second transistor terminal, the second resistor terminal being coupled to the third transistor terminal. For example, the method is implemented according to at least FIG. 5, FIG. 9 and/or FIG. 11.

In yet another embodiment, a method for dimming control using at least a system controller including a first controller terminal and a second controller terminal includes receiving an input signal at the first controller terminal, processing information associated with the input signal, and generating a dimming signal based on at least information associated with the input signal. Further, the method includes processing information associated with the dimming signal, generating a synchronization signal based on at least information associated with the dimming signal, processing information associated with the synchronization signal, and outputting a gate drive signal at the second controller terminal based on at least information associated with the synchronization signal. The process for generating a synchronization signal based on at least information associated with the dimming signal includes generating a first pulse of the synchronization signal in response to a first rising edge of the dimming signal, the first pulse including a first falling edge and being associated with a first pulse width. The process for outputting a gate drive signal at the second controller terminal based on at least information associated with the synchronization signal includes starting changing the gate drive signal between a first logic level and a second logic level for a first burst period at the first falling edge of the pulse. For example, the method is implemented according to FIG. 5, FIG. 6, FIG. 7, FIG. 8, FIG. 9, FIG. 10 and/or FIG. 11.

In yet another embodiment, a method for dimming control using at least a system controller including a first controller terminal and a second controller terminal includes receiving an input signal at the first controller terminal, processing information associated with the input signal, and generating a dimming signal based on at least information associated with the input signal, the dimming signal being associated with a dimming period. In addition, the method includes processing information associated with the dimming signal, and outputting a gate drive signal at the second controller terminal based on at least information associated with the dimming signal, the gate drive signal being related to a plurality of switching periods included within the dimming period. The plurality of switching periods include a plurality of on-time periods respectively. The plurality of on-time periods increase in duration over time. For example, the method is implemented according to FIG. 5, FIG. 6, FIG. 7, FIG. 8, FIG. 9, FIG. 10 and/or FIG. 11.

For example, some or all components of various embodiments of the present invention each are, individually and/or in combination with at least another component, implemented using one or more software components, one or more hardware components, and/or one or more combinations of software and hardware components. In another example, some or all components of various embodiments of the present invention each are, individually and/or in combination with at least another component, implemented in one or more circuits, such as one or more analog circuits and/or one or more digital circuits. In yet another example, various embodiments and/or examples of the present invention can be combined.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A system controller for dimming control, the system controller comprising:

a first controller terminal; and a second controller terminal;

wherein the system controller is configured to:

receive an input signal at the first controller terminal and generate a dimming signal based on at least information associated with the input signal;

generate a synchronization signal based on at least information associated with the dimming signal; and output a gate drive signal at the second controller terminal based on at least information associated with the synchronization signal;

wherein the system controller is further configured to:

generate a first pulse of the synchronization signal in response to a first rising edge of the dimming signal, the first pulse including a first falling edge and being associated with a first pulse width; and start changing the gate drive signal between a first logic level and a second logic level for a first burst period at the first falling edge of the pulse.

2. The system controller of claim 1 is further configured to:

generate a second pulse of the synchronization signal in response to a second rising edge of the dimming signal, the second pulse including a second falling edge and being associated with a second pulse width; and start changing the gate drive signal between the first logic level and the second logic level for a second burst period at the second falling edge of the pulse.

3. The system controller of claim 2 wherein the first pulse width and the second pulse width are the same.

4. The system controller of claim 1, and further comprising a first comparator configured to receive at least the input signal and generate the dimming signal based on at least information associated with the input signal.

5. The system controller of claim 4, and further comprising a synchronization component configured to receive the dimming signal and generate the synchronization signal based on at least information associated with the dimming signal.

6. The system controller of claim 5, and further comprising a gate driver configured to receive at least the synchronization signal and generate the gate drive signal based on at least information associated with the synchronization signal.

7. The system controller of claim 6, and further comprising:

a soft control component configured to receive the dimming signal and generate a control signal;

a multiplier configured to receive at least the input signal and the control signal and generate a multiplied signal based on at least information associated with the input signal and the control signal; and a second comparator configured to receive the multiplied signal and a current sensing signal associated with a current flowing through one or more light emitting diodes and output a modulation signal based on at least information associated with the multiplied signal and the current sensing signal to the gate driver.

8. The system controller of claim 1 wherein the second controller terminal is coupled, directly or indirectly, to a switch associated with a primary current flowing through a primary winding of a power conversion system, the power conversion system being used for driving one or more light emitting diodes.

9. The system controller of claim 8 wherein the switch is turned on or off in response to the gate drive signal in order to regulate the primary current.

10. The system controller of claim 1 wherein the second controller terminal is coupled, directly or indirectly, to a switch associated with a current flowing through an inductor, the inductor being coupled, directly or indirectly, to one or more light emitting diodes.

11. The system controller of claim 10 wherein the switch is turned on or off in response to the gate drive signal in order to regulate the current flowing through the inductor.

12. The system controller of claim 1 wherein the dimming signal is associated with one or more dimming periods.

13. The system controller of claim 12 is further configured to keep a duty cycle of the gate drive signal approximately constant at a predetermined value during each dimming period.

14. The system controller of claim 12 wherein:

the gate drive signal is related to a plurality of switching periods included within a dimming period associated with the dimming signal;

the plurality of switching periods include a plurality of on-time periods respectively; and the system controller is further configured to increase the plurality of on-time periods in duration over time.

15. A system controller for dimming control, the system controller comprising:

a first controller terminal; and a second controller terminal;

wherein the system controller is configured to:

receive an input signal at the first controller terminal and generate a dimming signal based on at least information associated with the input signal, the dimming signal being associated with a dimming period; and output a gate drive signal at the second controller terminal based on at least information associated with the dimming signal, the gate drive signal being related to a plurality of switching periods included within the dimming period;

wherein:

the plurality of switching periods include a plurality of on-time periods respectively; and the system controller is further configured to increase the plurality of on-time periods in duration over time.

16. The system controller of claim 15, and further comprising:

a first comparator configured to receive at least the input signal and generate the dimming signal based on at least information associated with the input signal; and a soft control component configured to receive the dimming signal and generate a control signal in order to adjust the gate drive signal to increase the plurality of on-time periods in duration over time.

17. The system controller of claim 16, and further comprising:

a multiplier configured to receive at least the input signal and the control signal and generate a multiplied signal based on at least information associated with the input signal and the control signal;

a second comparator configured to receive the multiplied signal and a current sensing signal associated with a current flowing through one or more light emitting diodes and generate a modulation signal based on at least information associated with the multiplied signal and the current sensing signal; and a gate driver configured to receive at least the modulation signal and generate the gate drive signal based on at least information associated with the modulation signal.

18. The system controller of claim 15 wherein the second controller terminal is coupled, directly or indirectly, to a switch associated with a primary current flowing through a primary winding of a power conversion system, the power conversion system being used for driving one or more light emitting diodes.

19. The system controller of claim 18, and further comprising:

a demagnetization component configured to receive a feedback signal associated with an output signal related to the one or more light emitting diodes and generate a demagnetization signal based on at least information associated with the feedback signal;

a current sensing component configured to receive a current sensing signal associated with a current flowing through the one or more light emitting diodes and the demagnetization signal and generate an output signal based on at least information associated with the current sensing signal and the demagnetization signal; and an error amplifier configured to receive at least the output signal and output an amplified signal.

20. The system controller of claim 15 wherein the second controller terminal is coupled, directly or indirectly, to a switch associated with a current flowing through an inductor, the inductor being coupled, directly or indirectly, to one or more light emitting diodes.

21. The system controller of claim 20, and further comprising:

a demagnetization component configured to receive the gate drive signal and generate a demagnetization signal based on at least information associated with the gate drive signal;

a current sensing component configured to receive a current sensing signal associated with the current flowing through the inductor and the demagnetization signal and generate an output signal based on at least information associated with the current sensing signal and the demagnetization signal; and an error amplifier configured to receive at least the output signal and output an amplified signal.

22. The system controller of claim 20, and further comprising:

a third controller terminal;

wherein the third controller terminal is configured to receive a detection signal associated with a demagnetization process of the inductor.

23. The system controller of claim 22, and further comprising:

a demagnetization component configured to receive the detection signal and generate a demagnetization signal based on at least information associated with the detection signal;

a current sensing component configured to receive a current sensing signal associated with the current flowing through the inductor and the demagnetization signal and generate an output signal based on at least information associated with the current sensing signal and the demagnetization signal; and an error amplifier configured to receive at least the output signal and output an amplified signal.

24. The system controller of claim 22 wherein the third controller terminal is coupled to a detection circuit configured to generate the detection signal.

25. The system controller of claim 24 wherein:

the detection circuit includes a capacitor and a resistor, the capacitor including a first capacitor terminal and a second capacitor terminal, the resistor including a first resistor terminal and a second resistor terminal;

the first capacitor terminal is coupled, directly or indirectly, to the inductor;

the second capacitor terminal is coupled to the first resistor terminal;

the first resistor terminal is coupled to the third controller terminal; and the second resistor terminal is biased at a first voltage.

26. The system controller of claim 15 is further configured to:

generate a pulse of a synchronization signal in response to a rising edge of the dimming signal during the dimming period, the pulse including a falling edge and being associated with a pulse width; and start changing the gate drive signal between a first logic level and a second logic level for a burst period at the falling edge of the pulse, the burst period being included within the dimming period.

27. A method for dimming control using at least a system controller including a first controller terminal and a second controller terminal, the method comprising:

receiving an input signal at the first controller terminal;

processing information associated with the input signal;

generating a dimming signal based on at least information associated with the input signal;

processing information associated with the dimming signal;

generating a synchronization signal based on at least information associated with the dimming signal;

processing information associated with the synchronization signal; and outputting a gate drive signal at the second controller terminal based on at least information associated with the synchronization signal;

wherein:

the process for generating a synchronization signal based on at least information associated with the dimming signal includes generating a first pulse of the synchronization signal in response to a first rising edge of the dimming signal, the first pulse including a first falling edge and being associated with a first pulse width; and the process for outputting a gate drive signal at the second controller terminal based on at least information associated with the synchronization signal includes starting changing the gate drive signal between a first logic level and a second logic level for a first burst period at the first falling edge of the pulse.

28. A method for dimming control using at least a system controller including a first controller terminal and a second controller terminal, the method comprising:

receiving an input signal at the first controller terminal;

processing information associated with the input signal;

generating a dimming signal based on at least information associated with the input signal, the dimming signal being associated with a dimming period;

processing information associated with the dimming signal; and outputting a gate drive signal at the second controller terminal based on at least information associated with the dimming signal, the gate drive signal being related to a plurality of switching periods included within the dimming period;

wherein:

the plurality of switching periods include a plurality of on-time periods respectively; and the plurality of on-time periods increase in duration over time.

* * * * *